US005871379A

United States Patent [19]

Tanaka et al.

[11] Patent Number: 5,871,379

[45] Date of Patent: Feb. 16, 1999

[54] BUTT TERMINAL OF TWO-PART CONSTRUCTION

[75] Inventors: Shigeru Tanaka; Isao Kameyama, both of Shizuoka, Japan

[73] Assignee: Yazaki Corporation, Tokyo, Japan

[21] Appl. No.: 889,434

[22] Filed: Jul. 8, 1997

[30] Foreign Application Priority Data

Jul. 10, 1996 [JP] Japan ..... 8-180687

[51] Int. Cl.[6] ..... H01R 13/24

[52] U.S. Cl. ..... 439/824; 439/700

[58] Field of Search ..... 439/824, 700, 439/289

[56] References Cited

U.S. PATENT DOCUMENTS

| | | | |
|---|---|---|---|
| 3,947,182 | 3/1976 | McCartney | 439/289 |
| 4,491,381 | 1/1985 | Hamsher, Jr. et al. | 339/107 |
| 4,591,222 | 5/1986 | Shaffer | 339/74 |
| 4,703,986 | 11/1987 | McCormick | 439/289 |
| 5,186,664 | 2/1993 | Abe | 439/845 |

*Primary Examiner*—Neil Abrams
*Assistant Examiner*—Jean F. Duverne
*Attorney, Agent, or Firm*—Sughrue, Mion, Zinn, Macpeak & Seas, PLLC

[57] ABSTRACT

A butt terminal in which the number of component parts is small, and a small-size design can be achieved, and a sufficient fitting displacement amount can be obtained, and a stable electrically-connected condition can be obtained. In the butt terminal of a two-part construction of the invention, a female terminal, having a sliding contact piece, and a male terminal are butted to be electrically connected together. The female terminal includes a box-like body of an electrically-conductive material which has a stamped piece portion which is formed on at least one of first opposed walls of the box-like body, and is bent inwardly to be slanting rearwardly, and sliding grooves formed respectively in second opposed walls. The sliding contact piece includes a push portion formed at a front end thereof for engagement with the male terminal, a contact portion which is formed at a rear end thereof, and contacts the stamped piece portion, and sliding projections which are formed respectively at opposite side edges thereof intermediate the opposite ends thereof, and can be guided respectively by the sliding grooves. The sliding contact piece is inserted into the box-like body from the front side of the box-like body.

6 Claims, 6 Drawing Sheets

BUTT TERMINAL OF TWO-PART CONSTRUCTION

BACKGROUND OF THE INVENTION

1. Field of the Invention

This invention relates to a butt terminal of a two-part construction in which a pair of male and female terminals are butted to be electrically connected together.

2. Background

There are known various butt terminals including a pair of male and female terminals, in which opposed contacts are butted together, thereby making an electrical connection. One such example is disclosed in U.S. Pat. No. 4,591,222.

In the conventional butt 51, shown in FIG. 9, a socket-type female terminal 52 and a pin-type male terminal 53 are butted to be electrically connected together.

A front half portion of the female terminal 52 is defined by a cylindrical tubular portion 54, and a plurality of slits 55 are formed through a front end portion of the cylindrical tubular portion 54, and extend axially, so that a plurality of resilient arms 57, separated from one another by the slits 55, are formed. The cylindrical tubular portion 54 is tapering toward its front end into a diameter smaller than an outer diameter of the male terminal 53. The front end of the cylindrical tubular portion 54 is flaring to provide an introductory portion 56 for receiving the male terminal 53.

A cap-like push member 61 for being pushed by a front end of the male terminal 53 is mounted in a socket cavity 58 defined by the resilient arm 57, and is movable back and forth. A compression spring 62 is provide at a rear end of the push member 61.

A rear half portion of the female terminal 52 is defined by a rod-like body portion 60 having a wire connection hole 59 formed in a rear end thereof, and the cylindrical tubular portion 54 is secured to a front end of the body portion 60.

In the above conventional butt terminal 51, when the front end of the male terminal 53 is fitted into the introductory portion 56 at the front end of the female terminal 52, the resilient arms 57 are spread radially outwardly by the outer peripheral surface of the male terminal 53, and the front end of the male terminal 53 abuts against the push member 61. When the male terminal 53 is further inserted to completely compress the compression spring 62, the connection between the female and male terminals 52 and 53 is completed. The female and male terminals 52 and 53 are retained by retaining mechanisms (not shown) provided on their housings.

With respect to the electrically-connected condition, the contact between the front end of the male terminal 53 and the push member 61 is a surface-to-surface contact, and the contact between the push member 61 and the compression spring 62, as well as the contact between the compression spring 62 and the body portion 60, is generally a line contact.

Next, another butt terminal different in construction from the above butt terminal will be described. As shown in FIG. 11, in the butt terminal 71, a male terminal 73 is pushed to be connected to a female terminal 72 from the upper side, the female terminal 72 being formed by bending a strip of an electrically-conductive material into a generally Z-shape. In this condition, a spring portion 74 of the female terminal 72 is compressed, so that a proper contact pressure is maintained between the female terminal 72 and the male terminal 73. A wire W is connected to an end of a bottom portion 75 of the female terminal 72.

In the above conventional butt terminal 51 shown in FIG. 9, however, when the male terminal 53 is inserted obliquely into the female terminal 52, the compression spring 62 is compressed in a curved condition as shown in FIG. 10, and therefore only an lower portion in FIG. 10 is compressed while an upper portion is not compressed, thus inviting a problem that the electrical connection is affected.

The female terminal 52 includes the push member 61 and the compression spring 62 which are provided within the cylindrical tubular portion 54, which leads to a problem that the number of the component parts is large, and the cost is increased.

In the butt terminal 71 shown in FIG. 11, if the amount of fitting displacement with respect to the male terminal 73 is large, it is necessary to increase a length L of the bottom portion 72 and a radius K of the spring portion 74 so that an internal stress of the female terminal 72 can be kept to within a yield strength of the material, and in this case there arises a problem that the female terminal 72 can not be formed into a small size.

Another problem is that since the direction of extending of the wire W from the female terminal is perpendicular to the direction of fitting of the male terminal 73, the female terminal 72 can not be formed into a small size in this respect.

SUMMARY OF THE INVENTION

With the above problems in view, it is an object of this invention to provide a butt terminal in which the number of component parts is small, and a small-size design can be achieved, and a sufficient fitting displacement amount can be obtained.

The above object of the invention has been achieved by a butt terminal of a two-part construction which includes a female terminal and a male terminal butted to be electrically connected together, in which the female terminal includes:

(i) a box-like body of an electrically-conductive material including a stamped piece portion which is formed on at least one of first opposed walls of the box-like body, and is bent inwardly, and sliding grooves formed respectively in second opposed walls of the box-like body, and (ii) a sliding contact piece including a push portion formed at a front end thereof for engagement with the male terminal, a contact portion which is formed at a rear end thereof, and contacts the stamped piece portion, and sliding projections which are formed respectively at opposite side edges thereof intermediate the opposite ends thereof, and can be guided respectively by the sliding grooves, the box-like body and the sliding contact piece being separate from each other.

The sliding grooves are formed parallel to the first opposed walls of the box-like body.

In the above butt terminal of the two-part construction, the female terminal includes the two parts, that is, the box-like body and the sliding contact piece, and therefore the number of the component parts is small, and the butt terminal can be formed into a small size.

The amount of displacement of the sliding contact piece itself is small, and therefore it can have a sufficient thickness and a sufficient width, and a sufficient area of contact between the front end of the male terminal and the push portion, as well as a sufficient area of contact between the stamped piece portion and the contact portion, can be secured, so that the stable electrically-connected condition can be obtained.

When the female and male terminals are to be fitted together, the contact portion is connected to the stamped piece portions while urging the stamped piece portions away from each other, so that a sufficient fitting displacement amount can be obtained.

Further, the above object can be achieved also by a butt terminal of a two-part construction, in which the stamped piece portion is bent perpendicularly from the one of the first opposed walls, and the sliding grooves are inclined at an angle with respect to the first opposed walls.

In this butt terminal of the two-part construction, the sliding grooves are inclined, and therefore during the process of fitting the female and male terminals together, the push portion is held in abrading contact with the front end of the male terminal, and also the contact portion is held in abrading contact with the stamped piece portion, and therefore oxide films on the surfaces of the materials are removed, and besides the sliding contact piece presses the male terminal and the stamped piece portion hard, so that the electrically-connected condition is further improved.

Further, the above object has been achieved also by a butt terminal of a two-part construction, in which the stamped piece portion is bent at an acute angle with respect to the one of the first opposed walls, and the sliding grooves are inclined at an angle smaller than the acute angle.

In this butt terminal of the two-part construction, by suitably determining the acute angle of bending of the stamped piece portion and the angle of inclination of the sliding grooves (which is smaller than the acute angle of bending of the stamped piece portion), a desired fitting displacement amount can be selected within a yield strength of the sliding contact piece, without inviting an undue concentration of stresses, and the degree of freedom of the design is enhanced, and the reliability can be further enhanced.

Further, the above object has been achieved also by a butt terminal of a two-part construction, in which the push portion of the sliding contact piece is formed into a small curvature, and that portion of the sliding contact piece, disposed adjacent to the contact portion, is formed into a large curvature.

In this butt terminal of the two-part construction, that portion of the sliding contact piece, disposed adjacent to the contact portion, has the large curvature, and therefore the area of contact between the stamped piece portion and the contact portion of the sliding contact piece is increased, and also the fitting displacement amount can be increased, and therefore the length of abrading contact of the contact portion of the sliding contact piece with the stamped piece portion is increased, so that oxide films can be removed over a wide range. Since the push portion of the sliding contact piece has the small radius, the abrading contact of the push portion of the sliding contact piece with the front end of the male terminal can be made stable.

DETAILED DESCRIPTION OF THE PREFERRED EMBODIMENTS

Preferred embodiments of the present invention will now be described in detail with reference to FIGS. 1 to 8.

First Embodiment

Figure 1:
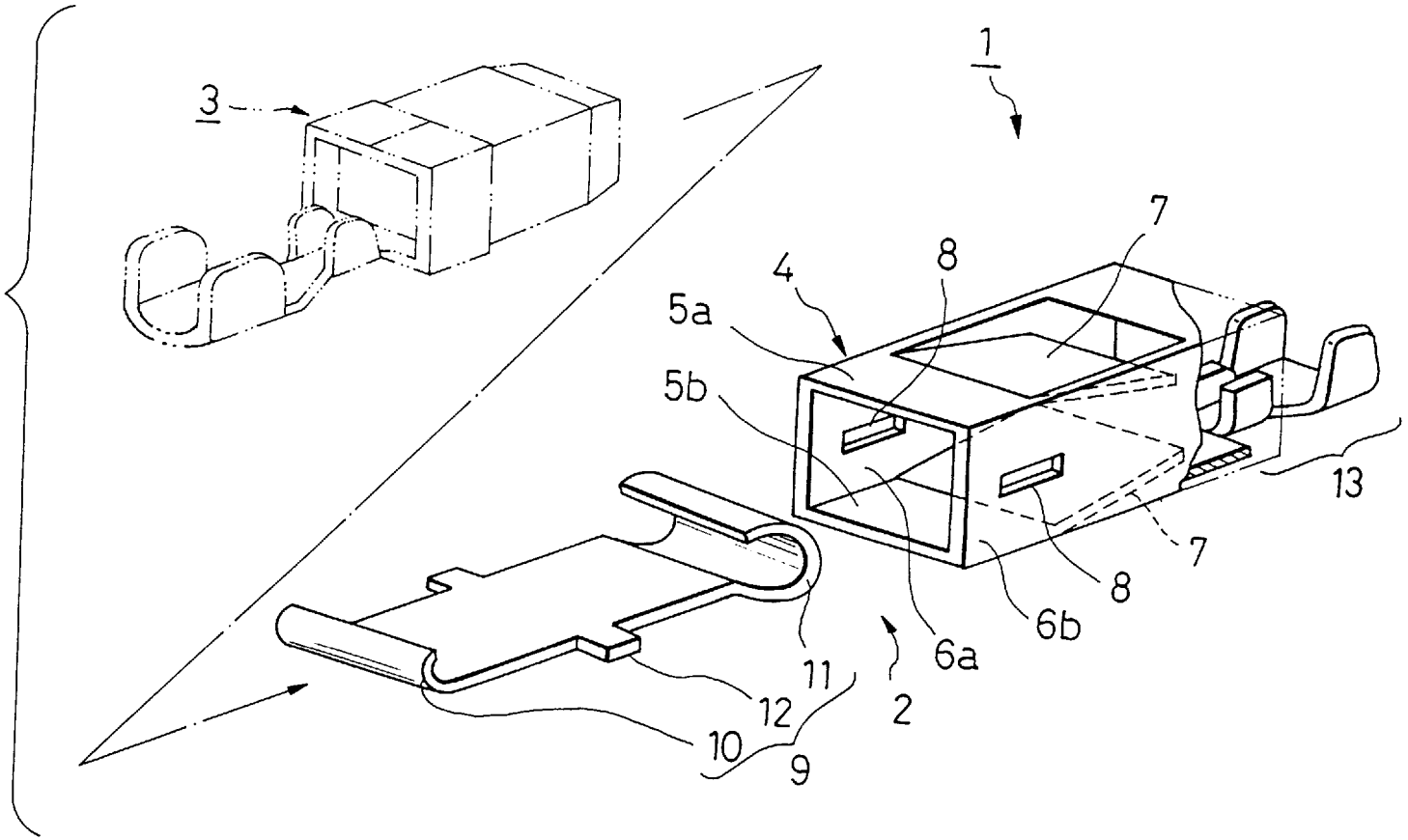
FIG. 1 is an exploded, perspective view of a first embodiment of a butt terminal of a two-part construction of the invention.

As shown in FIG. 1, in a butt terminal 1 according to the first embodiment of the invention, female and male terminals 2 and 3 are butted to be electrically connected together. The female terminal 2 includes two parts, that is, a box-like body 4 made of an electrically-conductive material, and a plate-like, sliding contact piece 9 slidably mounted within this box-like body 4.

The box-like body 4 includes a pair of stamped piece portions 7 and 7 which are formed respectively on a pair of first opposed walls 5*a* and 5*b*, and are bent inwardly to be slanting rearwardly at a predetermined angle, a pair of sliding grooves 8 and 8 formed respectively through a pair of second opposed walls 6*a* and 6*b* in parallel relation to the first opposed walls 5*a* and 5*b*, and a wire clamping portion 13 to which a wire is connected.

The sliding contact piece 9 includes a push portion 10 formed at a front end thereof for engagement with the male terminal 3, a contact portion 11 which is formed at a rear end thereof, and contacts the stamped piece portions 7, and a pair of sliding projections 12 which are formed respectively at opposite side edges thereof intermediate the opposite ends thereof, and are fitted respectively in the sliding grooves 8.

Figure 2:
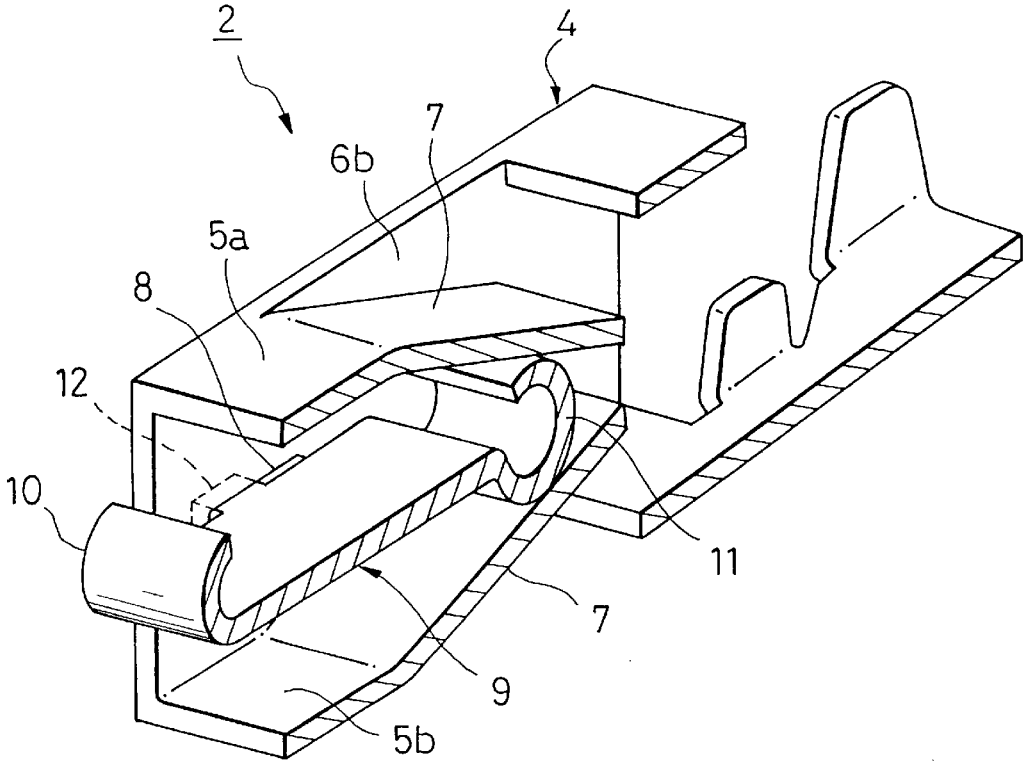
FIG. 2 is a vertical cross-sectional, perspective view, showing an internal structure of a female terminal of FIG. 1.
Figure 3:
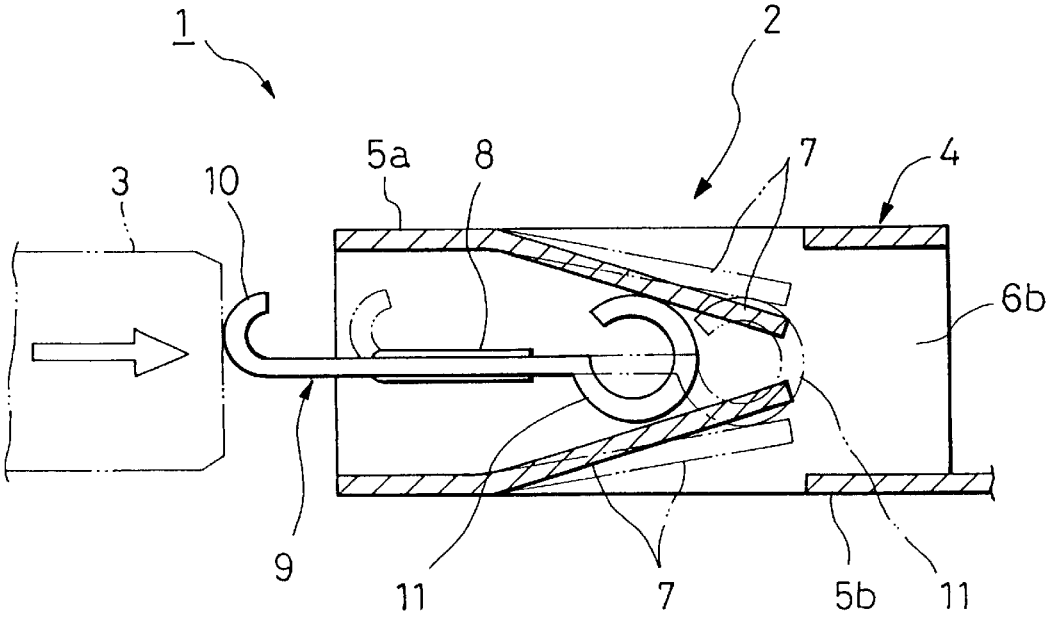
FIG. 3 is a view showing the operation in FIG. 1.

In the first embodiment of the above construction, when the sliding projections 12 of the sliding contact piece 9 are fitted respectively in the sliding grooves 8 in the box-like body 4 as shown in FIG. 2, the sliding projections 12 are disposed at front ends of the sliding grooves 8, respectively, and also the contact portion 11 is slightly held between the two stamped piece portions 7 in contact therewith.

When the male terminal 3 is fitted into the box-like body 4 of the female terminal 2 as shown in FIG. 2, the front end of the male terminal 3 abuts against the push portion 10 of the sliding contact piece 9 to push the sliding contact piece 9 rearwardly. Therefore, the contact portion 11 is moved rearwardly, and is more firmly pressed against the two stamped piece portions 7, so that the pressure of contact between the front end of the male terminal 3 and the push portion 10 increases. Therefore, a good electrical connection between the male terminal 3 and the female terminal 2 is achieved.

Retaining mechanisms for retaining the female and male terminals 2 and 3 in the connected condition are provided respectively in their housings (not shown), and when the female and male terminals 2 and 3 are connected together, these retaining mechanisms are retaining engaged with each other.

In the butt terminal 1 of this embodiment, the female terminal 2 is formed in the two parts, that is, the box-like body 4 and the sliding contact piece 9, and therefore the number of the component parts is small, and besides the direction of extending of the wires, connected respectively to the female and male terminals, is the same as the direction of fitting of the female and male terminals, and therefore the overall size of the butt terminal 1 can be made small, and the cost can be reduced.

The sliding contact piece 9 is guided by the sliding grooves 8, and therefore even if the male terminal 3 is obliquely fitted into the female terminal 2, the path of movement of the sliding contact piece 9 is not influenced, and the electrical contact of the male terminal 3 with the box-like body 4 through the sliding contact piece 9 and the stamped piece portions 7 is stable and reliable. Furthermore, since the contact portion 11 moves between the two stamped piece portions 7 and 7 in sliding contact therewith, a sufficient fitting displacement amount can be secured within a yield strength of the resilient portion.

Second Embodiment

Figure 4:
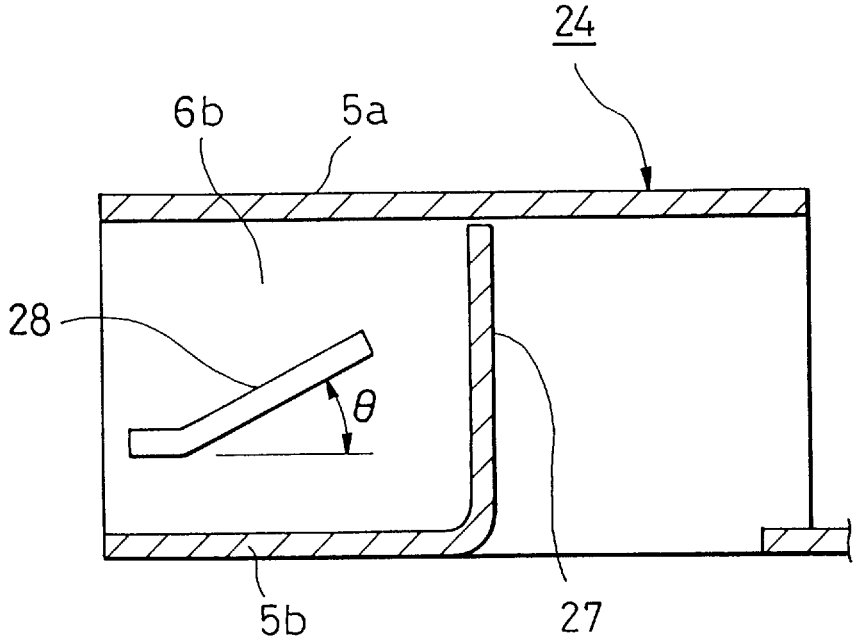
FIG. 4 is a vertical cross-sectional view of a female terminal in a second embodiment of a butt terminal of a two-part construction of the invention.

Next, a second embodiment of a butt terminal of a two-part construction of the invention will be described with reference to FIGS. 4 to 6. As shown in FIG. 4, this embodiment differs from the first embodiment in that a stamped piece portion 27 is formed only on one (5*b*) of first opposed walls 5*a* and 5*b* of a box-like body 24, and is inwardly bent perpendicularly (that is, at right angles), and that sliding grooves 28 are inclined at an angle θ with respect to the wall 5*b*.

Figure 5:
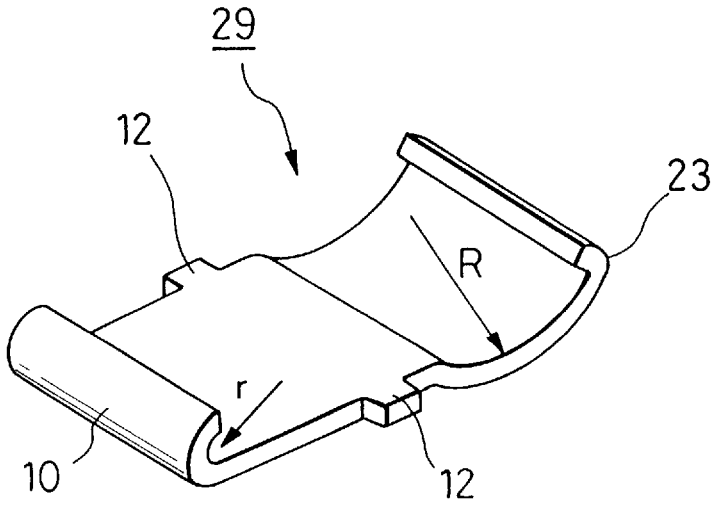
FIG. 5 is a perspective view of a sliding contact piece engaged with a box-like body in FIG. 4.

As shown in FIG. 5, a push portion 10 of a sliding contact piece 29 has a small curvature r, and that portion of the sliding contact piece 29, disposed adjacent to a contact portion 23, has a large curvature R. Those parts identical to those of the preceding embodiment will be designated by identical reference numerals, respectively, and explanation thereof will be omitted.

Figure 6:
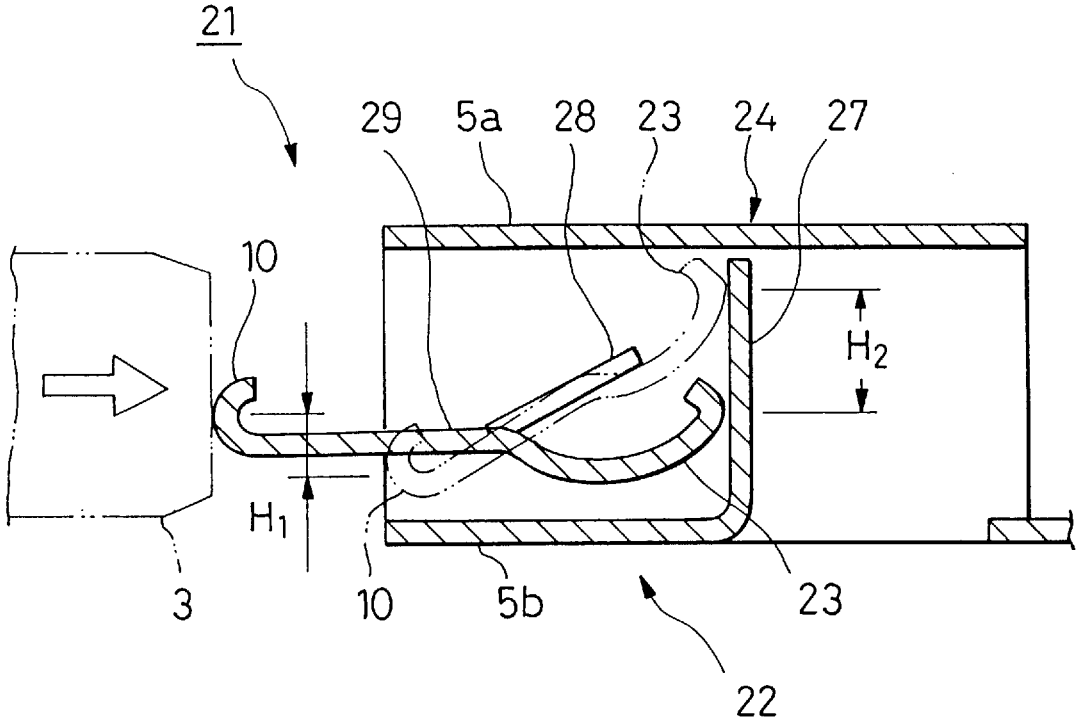
FIG. 6 is a view showing the operation in FIGS. 4 and 5.

In the butt terminal 21 of the second embodiment having the above construction, when a front end of a male terminal 3 pushes the push portion 10 of a female terminal 22 as shown in FIG. 6, the sliding contact piece 29 is moved rearwardly while being guided by the sliding grooves 28 inclined at the angle θ. The push portion 10 approaches the wall 5*b* a distance H1 from its initial position, and also the contact portion 23 is brought into contact with the stamped piece portion 27, and then slidingly moves over the stamped piece portion 27 a distance H2 to abut against the wall 5*a*. At this time, the contact portion 23 of the sliding contact piece 29, having the large curvature R, and that portion of the sliding contact piece 29, disposed forwardly of sliding projections 12 (see FIG. 5), are flexed, and therefore the pressure of contact between the front end of the male terminal 3 and the push portion 10, as well as the pressure of contact between the contact portion 23 and the stamped piece portion 27, is increased, and also the area of contact between the stamped piece portion 27 and the contact portion 23 is increased, and therefore the good electrically-connected condition is maintained.

In the butt terminal 21 of this embodiment, the female terminal 22 is formed in the two parts, that is, the box-like body 24 and the sliding contact piece 29, and therefore the number of the component parts is small, and besides the direction of extending of wires, connected respectively to the female and male terminals, is the same as the direction of fitting of the female and male terminals, and therefore the overall size of the butt terminal 21 can be made small, and the cost can be reduced.

The sliding contact piece 29 is guided by the sliding grooves 28, and therefore even if the male terminal 3 is obliquely fitted into the female terminal 22, the path of movement of the sliding contact piece 29 is not influenced, and the electrical contact of the male terminal 3 with the box-like body 24 through the sliding contact piece 29 and the stamped piece portion 27 is stable and reliable. Furthermore, since the contact portion 23 moves in sliding contact with the stamped piece portion 27, a sufficient fitting displacement amount can be secured within a yield strength of the resilient portion.

And besides, during the process of connecting the female and male terminals together, the push portion 10 and the contact portion 23 are held in sliding contact with their respective associated contact portions while being flexed, and therefore the length of abrading contact of the contact portion 23 of the sliding contact piece 29 with the stamped piece portion 27 increases, so that oxide films on the surfaces of the contact portions can be removed over a wide area. Furthermore, since the push portion 10 has the small curvature r, the front end of the male terminal 3 and the push portion 10 can be stably kept in sliding relation to each other. Therefore, the stable electrically-connected condition can be obtained, so that the more reliable butt terminal can be obtained.

Third Embodiment

Figure 7:
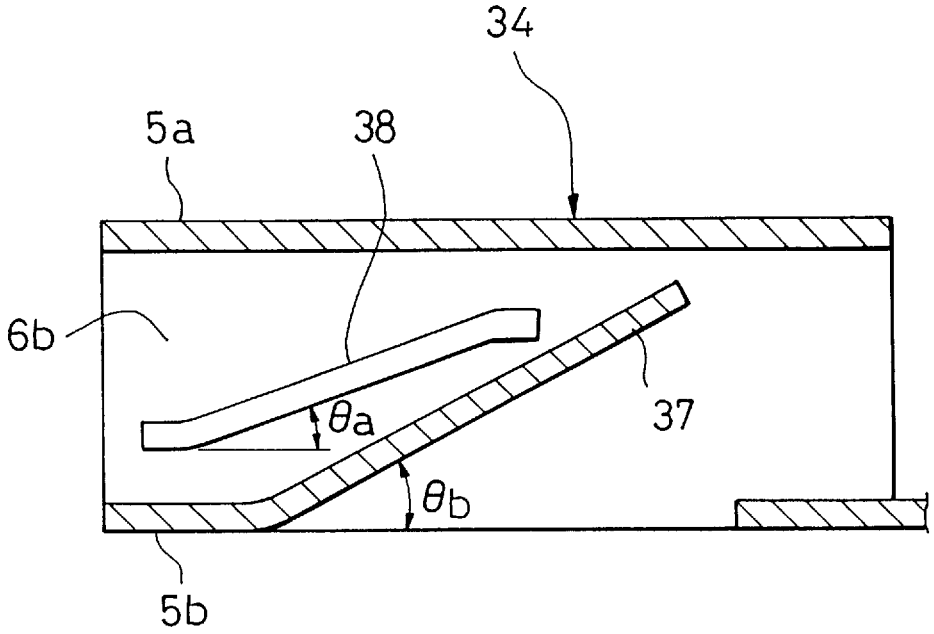
FIG. 7 is a vertical cross-sectional view of a female terminal in a third embodiment of a butt terminal of a two-part construction of the invention.

Next, a third embodiment of a butt terminal of a two-part construction of the invention will be described with reference to FIGS. 7 and 8. This embodiment differs from the above second embodiment in that a stamped piece portion 37 is formed on one (5*b*) of first opposed walls 5*a* and 5*b* of a box-like body 34, and is inwardly bent at an acute angle θb, and that sliding grooves 38 are inclined at an angle θa with respect to the wall 5*b*. The acute angle θb is larger than the inclination angle θa. Those parts identical to those of the above embodiments will be designated by identical reference numerals, respectively, and explanation thereof will be omitted.

Figure 8:
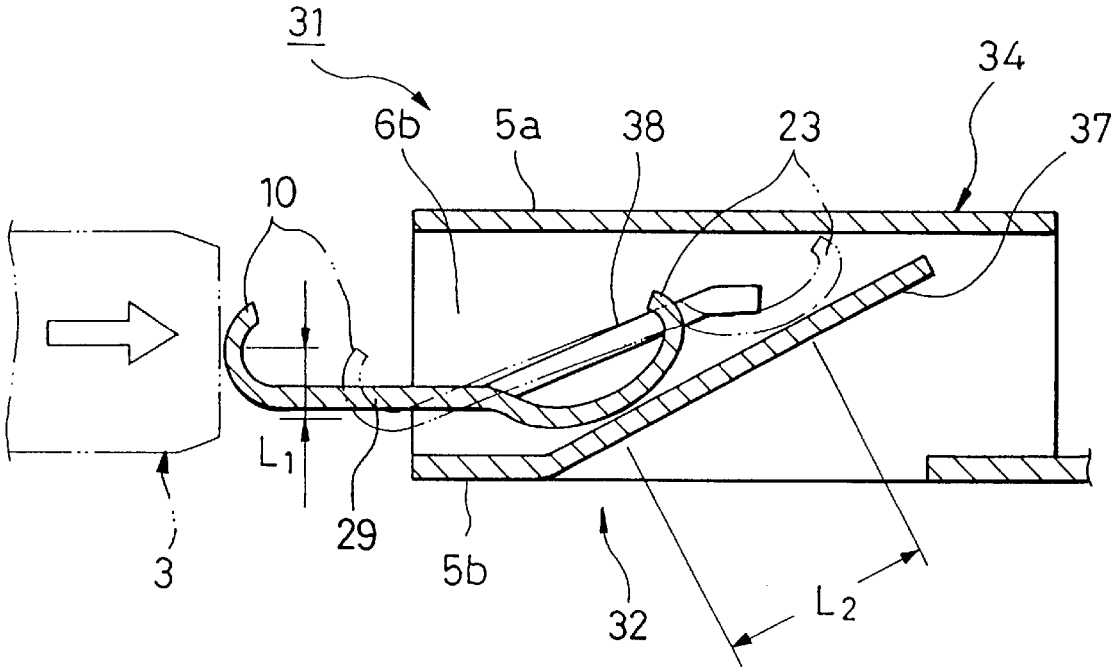
FIG. 8 is a view showing the operation in FIGS. 7 and 8.
Figure 9:
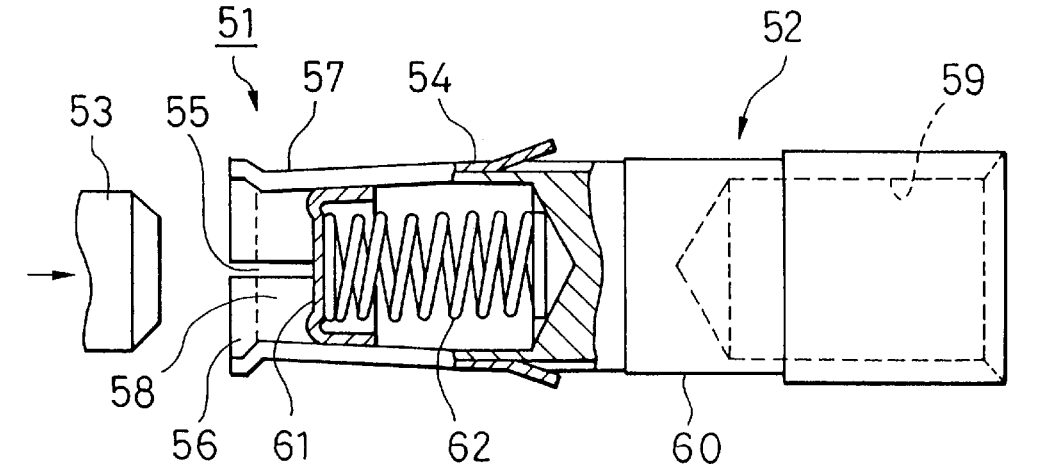
FIG. 9 PRIOR ART
FIG. 9 is a vertical cross-sectional view of a conventional butt terminal.
Figure 10:
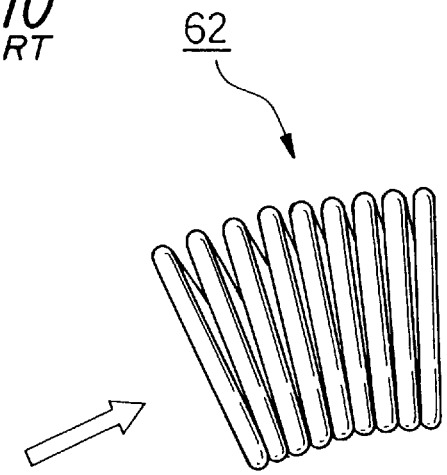
FIG. 10 PRIOR ART
FIG. 10 is a view showing the operation of a compression spring in FIG. 9.
Figure 11:
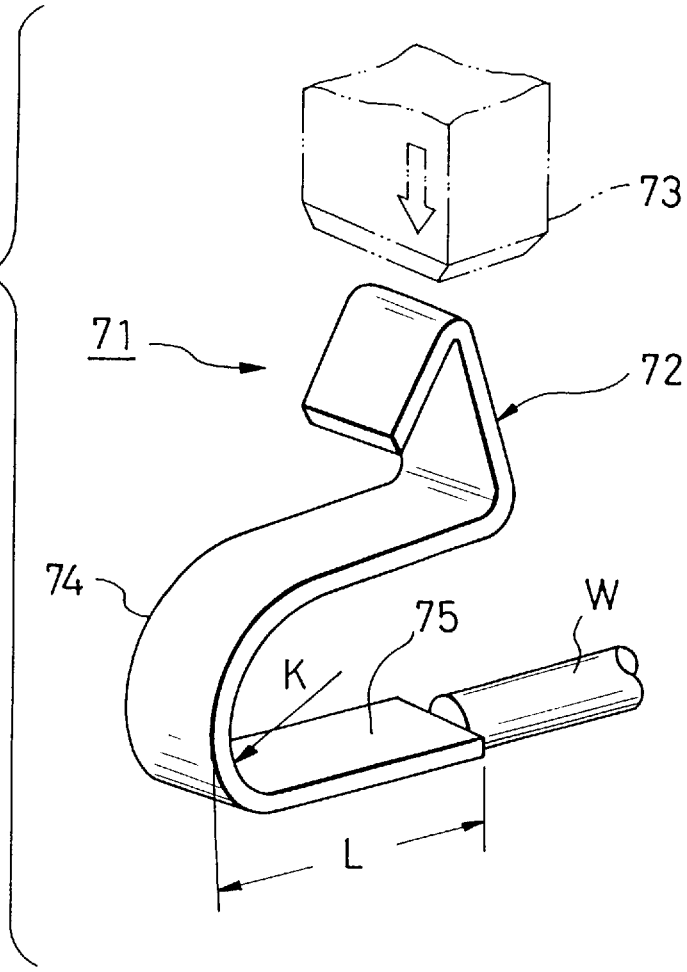
FIG. 11 PRIOR ART
FIG. 11 is a vertical cross-sectional view of another conventional butt terminal.

In the butt terminal 31 of this embodiment, when a front end of a male terminal 3 pushes a push portion 10 of a sliding contact piece 29 as shown in FIG. 8, the sliding contact piece 29 is moved rearwardly while being guided by the sliding grooves 38 inclined at the angle θa. The push portion 10 of the sliding contact piece 9 approaches the wall 5*b* a distance L1 from its initial position, and also a contact portion 23 is brought into contact with the stamped piece portion 37, and then slidingly moves over the stamped piece portion 37 a distance L2 to abut against the wall 5*a*. At this time, the contact portion 23, having a large curvature R, and that portion of the sliding contact piece 29, disposed forwardly of sliding projections 12 (see FIG. 5), are flexed, and therefore the pressure of contact between the front end of the male terminal 3 and the push portion 10, as well as the pressure of contact between the contact portion 23 and the stamped piece portion 37, is increased, and also the area of contact between the stamped piece portion 37 and the contact portion 23 is increased, and therefore the good electrically-connected condition is maintained.

In the butt terminal 31 of this embodiment, a female terminal 32 is formed in the two parts, that is, the box-like body 34 and the sliding contact piece 29, and therefore the number of the component parts is small, and besides the direction of extending of wires, connected respectively to the female and male terminals, is the same as the direction of fitting of the female and male terminals, and therefore the overall size of the butt terminal 31 can be made small, and the cost can be reduced.

The sliding contact piece 29 is guided by the sliding grooves 38, and therefore even if the male terminal 3 is obliquely fitted into the female terminal 32, the path of movement of the sliding contact piece 29 is not influenced, and the electrical contact of the male terminal 3 with the box-like body 34 through the sliding contact piece 29 and the stamped piece portion 37 is stable and reliable. Furthermore, since the contact portion 23 moves in sliding contact with the stamped piece portion 37, a sufficient fitting displacement amount can be secured within a yield strength of the resilient portion.

And besides, during the process of connecting the female and male terminals together, the push portion 10 of the sliding contact piece 29 and the contact portion 23 are held in sliding contact with the contact portion of the male terminal 3 and the associated contact portion, respectively, and therefore oxide films on the surfaces of the contact portions can be removed as in the above embodiment, so that the stable electrically-connected condition can be obtained.

As described above, $\theta a<\theta b$ is established, and therefore by suitably determining the inclination angle $\theta a$ and the acute angle $\theta b$, a desired fitting displacement amount can be selected within a yield strength of the resilient portion of the sliding contact piece 29, without inviting an undue concentration of stresses, and the degree of freedom of the design is enhanced, and the more reliable butt terminal can be obtained.

The present invention is not limited to the above embodiments, and various modifications can be made. For example, in the second and third embodiments, although the stamped piece portions 27 and 37 are disposed respectively at the right angles and the acute angle with respect to the wall 5*b,* these stamped piece portions 27 and 37 may be so constructed as to be positively flexed. However, in this case, the thickness and the length need to be so determined that the internal stress of the stamped piece portions 27 and 37 can be kept within the yield strength of the material.

In the butt terminal of the two-part construction, the female terminal includes the box-like body of an electrically-conductive material including the stamped piece portion which is formed on at least one of first opposed walls of the box-like body, and is bent inwardly, and the sliding grooves formed respectively in the second opposed walls of the box-like body, and the sliding contact piece including the push portion formed at the front end thereof for engagement with the male terminal, the contact portion which is formed at the rear end thereof, and contacts the stamped piece portion, and the sliding projections which are formed respectively at the opposite side edges thereof intermediate the opposite ends thereof, and can be guided respectively by the sliding grooves, the box-like body and the sliding contact piece being separate from each other. The sliding grooves are formed parallel to the first opposed walls of the box-like body.

Thus, the female terminal includes the two parts, that is, the box-like body and the sliding contact piece, and therefore the number of the component parts is small, and the butt terminal can be formed into a small size.

The amount of displacement of the sliding contact piece itself is small, and therefore it can have a sufficient thickness and a sufficient width, and when the female and male terminals are to be fitted together, the contact portion is connected to the stamped piece portions while urging the stamped piece portions away from each other, so that the sufficient pressure of contact between the front end of the male terminal and the push portion, as well as the sufficient pressure of contact between the stamped piece portions and the contact portion, can be obtained, and therefore the stable electrically-connected condition can be obtained.

In the butt terminal of the two-part construction, the stamped piece portion is bent perpendicularly from the one of the first opposed walls, and the sliding grooves are inclined at an angle with respect to the first opposed walls.

Thus, the sliding grooves are inclined, and therefore during the process of fitting the female and male terminals together, the push portion is held in abrading contact with the front end of the male terminal, and also the contact portion is held in abrading contact with the perpendicularly-bent stamped piece portion, and therefore oxide films on the surfaces of the materials are removed, and besides the sliding contact piece presses the male terminal and the stamped piece portion hard, so that the electrically-connected condition is further improved.

In the butt terminal of the two-part construction, the stamped piece portion is bent at an acute angle with respect to the one of the first opposed walls, and the sliding grooves are inclined at an angle smaller than the acute angle.

Therefore, by suitably determining the acute angle of bending of the stamped piece portion and the angle of inclination of the sliding grooves (which is smaller than the acute angle of bending of the stamped piece portion), a desired fitting displacement amount can be selected within a yield strength of the sliding contact piece, without inviting an undue concentration of stresses, and the degree of freedom of the design is enhanced, and the reliability can be further enhanced.

In the butt terminal of the two-part construction, the push portion of the sliding contact piece is formed into a small curvature, and that portion of the sliding contact piece, disposed adjacent to the contact portion, is formed into a large curvature.

Thus, that portion of the sliding contact piece, disposed adjacent to the contact portion, has the large curvature, and therefore the area of contact between the stamped piece portion and the contact portion of the sliding contact piece is increased, and also the fitting displacement amount can be increased, and therefore the length of abrading contact of the contact portion of the sliding contact piece with the stamped piece portion is increased, so that oxide films can be removed over a wide range. Since the push portion of the sliding contact piece has the small radius, the abrading contact of the push portion of the sliding contact piece with the front end of the male terminal can be made stable, and the electrically-connection condition is stable and reliable.

What is claimed is:

1. A terminal, comprising:

an electrically-conductive material including a conductor connecting portion for connecting a conductor thereto and a terminal connecting portion for mating with another terminal, the terminal connecting portion including:

a hollow box-like body having a stamped piece portion which is formed on at least one of first opposed walls of the box-like body, and is bent inwardly, and sliding grooves formed in second opposed walls of the box-like body, respectively; and a sliding contact piece having a push portion formed at a front end thereof for engagement with the another terminal, a contact portion which is formed at a rear end thereof, and contacts the stamped piece portion, and sliding projections which are formed respectively at opposite side edges thereof, and can be guided respectively by the sliding grooves.

2. The terminal of claim 1, wherein the box-like body and the sliding contact piece are formed by separate members, respectively.

3. The terminal of claim 1, wherein the sliding grooves are formed parallel to the first opposed walls of the box-like body.

4. The terminal of claim 1, wherein the stamped piece portion is bent perpendicularly from the one of the first opposed walls, and the sliding grooves are inclined at an angle with respect to the first opposed walls.

5. The terminal of claim 1, wherein the stamped piece portion is bent at an acute angle with respect to the one of the first opposed walls, and the sliding grooves are inclined at an angle smaller than the acute angle.

6. The terminal of claim 1, wherein the push portion of the sliding contact piece is formed into a small curvature, and that portion of the sliding contact piece, disposed adjacent to the contact portion, is formed into a large curvature.

* * * * *